US005984805A

United States Patent [19]

Maruko

[11] Patent Number: 5,984,805

[45] Date of Patent: Nov. 16, 1999

[54] GOLF BALL

[75] Inventor: Takashi Maruko, Saitama, Japan

[73] Assignee: Bridgestone Sports Co., Ltd., Tokyo, Japan

[21] Appl. No.: 09/090,859

[22] Filed: Jun. 5, 1998

[30] Foreign Application Priority Data

Jun. 6, 1997 [JP] Japan ..... 9-149103

[51] Int. Cl.[6] ..... A63B 37/08

[52] U.S. Cl. ..... 473/354; 473/355; 473/368; 473/370

[58] Field of Search ..... 473/354, 355, 473/368, 369, 370, 373, 374, 375, 376

[56] References Cited

U.S. PATENT DOCUMENTS 5,823,889 10/1998 Aoyama ..... 473/370 X 5,827,133 10/1998 Chang ..... 473/374 X

*Primary Examiner*—George J. Marlo

*Attorney, Agent, or Firm*—Sughrue, Mion, Zinn, Macpeak & Seas, PLLC

[57] ABSTRACT

A golf ball includes a spherical outer-layer core having a concentric spherical inner cavity and having a wall thickness of 5–10 mm. A spherical inner-layer core having a diameter smaller than that of the spherical cavity is disposed within the spherical cavity of the outer-layer core. A cover is formed on the outer surface of the outer-layer core. A liquid is charged into the space between the outer-layer core and the inner-layer core to thereby form a liquid layer having a thickness of 1–3 mm. The liquid has a specific gravity substantially equal to that of the material of the inner-layer core. In the golf ball, the inner-layer core and outer-layer core can rotate independently while the golf ball is traveling. Also, the golf ball has sufficient resilience and strength.

9 Claims, 1 Drawing Sheet

GOLF BALL

BACKGROUND OF THE INVENTION

1. Field of the Invention

The present invention relates to a golf ball comprising a spherical outer-layer core having a spherical inner cavity and a spherical inner-layer core disposed within the spherical cavity, wherein the outer core and the inner core rotate independently when the golf ball is traveling.

2. Related Art

Solid golf balls, such as two-piece golf balls, three-piece golf balls, etc. are usually produced by a process which comprises compression or injection molding for enclosing a solid core with a cover material and for forming dimples on the cover material, and finishing processing such as coating or mark stamping. In this case, a single-layer solid core or a multi-layer solid core composed of a plurality of solid layers has conventionally been used as a core of the solid golf ball.

In relation to the multi-layer solid core, the present inventors conceived a structure of a golf ball in which a spherical inner-layer core is disposed within a spherical cavity of a spherical outer-layer core, and a liquid is present in the space between the outer-layer core and the inner-layer core. With this structure, when the golf ball is traveling, the outer-layer core and the inner-layer core rotate independently and the inner-layer core rotates within the outer-layer core without receiving any air resistance, with the result that the golf ball can obtain a gyro moment. By virtue of this moment, the rate of spin is stabilized, the angle of fall becomes flat relative to the ground, travel distance is extended, and the straightness of the ball's trajectory is improved. Subsequently, the present inventors conducted a study in order to obtain such a golf ball.

As a result, the present inventors found that, depending on the thickness of the liquid layer between the outer-layer core and the inner-layer core, the inner-layer may not be able to rotate independently of the outer-layer core or lowers resilience of the golf ball; that, depending on the respective specific gravities of the inner-layer core and the liquid layer, the inner-layer core may not be able to rotate independently of the outer-layer core; and that, depending on the wall thickness of the outer-layer core, sufficient resilience and strength of the golf ball may not be secured.

SUMMARY OF THE INVENTION

The present invention has been achieved based on the above-mentioned findings. An object of the present invention is to provide a golf ball which includes a spherical outer-layer core having a spherical inner cavity, a spherical inner-layer core disposed within the spherical cavity in the outer-layer core, and a liquid present in the space between the outer-layer core and the inner-layer core, whose inner-layer core and outer-layer core can rotate independently while the golf ball is traveling, and which has sufficient resilience and strength to thereby obtain the above-mentioned desired action and property.

To achieve the above object, the present invention provides a golf ball comprising a spherical outer-layer core having a concentric spherical inner cavity and having a wall thickness of 5–10 mm; a spherical inner-layer core having a diameter smaller than that of the spherical cavity and disposed within the spherical cavity; and a cover formed on the outer surface of the outer-layer core, wherein a liquid having a specific gravity substantially equal to that of the material of the inner-layer core is charged into the space between the outer-layer core and the inner-layer core to thereby form a liquid layer having a thickness of 1–3 mm.

In the golf ball according to the present invention, the liquid layer has a thickness of 1–3 mm and has a specific gravity substantially equal to that of the material of the inner-layer core so that the inner-layer core can rotate independently of the outer-layer core without receiving any air resistance when the golf ball is traveling. With this structure, a gyro moment is generated in the golf ball when the golf ball is traveling. By virtue of this moment, the rate of spin is stabilized, the angle of fall becomes flat relative to the ground, travel distance is extended, and the straightness of the ball's trajectory is improved. In addition, the wall thickness of the outer-layer core is made 5–10 mm so that resilience and strength can be secured with no decrease in travel distance or damage to the golf ball.

DESCRIPTION OF THE PREFERRED EMBODIMENT

Figure 1:
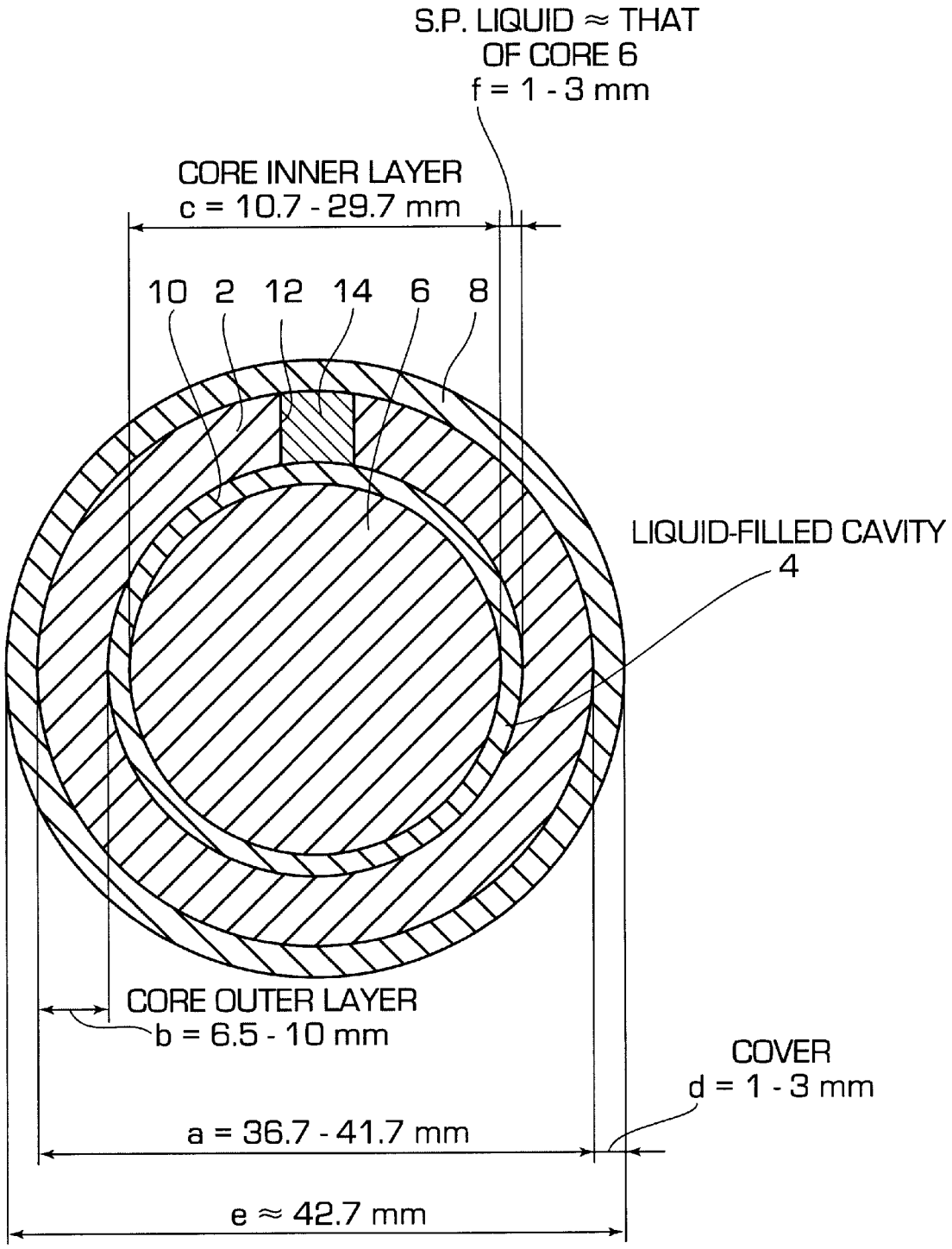
FIG. 1 is a sectional view showing a golf ball according to an embodiment of the present invention.

Next will be described the respective parts composing the golf ball, as well as a method for manufacturing the golf ball. The size and weight of the golf ball of the present invention conforms to the Golf Rules. Accordingly, the golf ball is required to have a diameter of 42.67 mm or more and a weight of 45.92 g or less.

Outer-layer Core

The material of the outer-layer core is not particularly limited and there may be used vulcanized rubber containing, as a main component, polybutadiene rubber, polyisoprene rubber, natural rubber, silicone rubber, or like rubber. Preferably, vulcanized rubber containing polybutadiene rubber as a main component is used. The outer-layer core may have a single-layer structure made of a single type of material or a multi-layer structure composed of a plurality of layers each made of a different type of material.

The outer diameter of the outer-layer core is preferably 36.7–41.7 mm, more preferably 37.7–40.7 mm. In the golf ball of the present invention, the wall thickness of the outer-layer core is 5–10 mm, preferably 6–9 mm, in order to secure sufficient resilience and strength. If the wall thickness of the outer-layer core is less than 5 mm, the resilience and strength of the outer-layer core are lowered, resulting in a decreased travel distance, and the outer-layer core becomes susceptible to damage when the golf ball is hit. If the wall thickness is more than 10 mm, the size of the inner-layer core becomes excessively small, resulting in an insufficient gyro moment effect.

Inner-Layer Core

As material of the inner-layer core, there may be used the above-mentioned materials for the outer-layer core. The diameter of the inner-layer core is preferably 10.7–29.7 mm, more preferably 15.0–25.0 mm. The inner-layer core may have an single-layer structure made of a single type of material or a multi-layer structure composed of a plurality of layers each made of a different type of material.

Cover

The material of the cover is not particularly limited and there may be used material such as ionomer resin, urethane resin, polyester resin, a mixture of urethane resin and polyester resin, or like resin. The cover preferably has a thickness of 0.5–3 mm, more preferably 1.0–2.5 mm. The cover may have an single-layer structure made of a single type of material or a multi-layer structure composed of a plurality of layers each made of a different type of material.

Liquid Layer

As liquid charged into the space between the outer-layer core and the inner-layer core to form a liquid layer, there is used a liquid having a specific gravity substantially equal to that of the inner-layer core. If the specific gravity of the liquid layer and that of the inner-layer core are not substantially equal, the inner-layer core comes into contact with the outer-layer core when the ball is traveling. As a result, the inner-layer core cannot rotate independently of the outer-layer core.

Since the specific gravity of the inner-layer core is usually 0.9–1.2, the specific gravity of the liquid of the liquid layer is adjusted to fall in the same range. As the liquid for forming the liquid layer, there is preferably used a liquid that has a low viscosity. Specifically, there is used a liquid having a viscosity of 1–100 centipoise, more preferably 1–50 centipoise. Such liquid facilitates the rotation of the inner-layer core. An example of such low viscosity liquid is water that contains sodium sulfate ($Na_2SO_4$) as an agent to adjust specific gravity.

The thickness of liquid layer is 1–3 mm, preferably 1.5–2.5 mm. If the thickness is less than 1 mm, the inner-layer core cannot rotate independently of the outer-layer core since the inner-layer core comes into contact with the outer-layer core when the golf ball is traveling, whereas if the thickness is more than 3 mm, the golf ball loses energy and its resilience is lowered, with the result that the travel distance is decreased.

Method of Manufacture

The golf ball of the present invention may be manufactured by an arbitrary method. For example, the following procedure may be advantageously employed.

(1) An inner-layer core is formed through vulcanization and molding. A pair of like hemispheric cups are molded from unvulcanized rubber. These two hemispheric cups are subjected to primary vulcanization (semi cure).

(2) These two hemispheric cups which have undergone the primary vulcanization are put on the inner-layer core in such a manner that the cups enclose the inner-layer core. In this case, one of the hemispheric cups has a liquid-charging through hole formed in the wall thereof. Next, the hemispheric cups are subjected to secondary vulcanization (full cure) so that the hemispheric cups become adhered to each other, to thereby form an outer-layer core around the inner-layer core.

(3) A liquid is charged into the space between the outer-layer core and the inner-layer core through the liquid-charging through hole formed in the wall of the outer-layer core, to thereby form a liquid layer. Then the liquid-charging through hole is plugged up with a rubber sealing plug made of the same material as that used for the outer-layer core.

(4) A cover is formed on the outer-layer core through compression or injection molding, during which dimples are formed on the cover. The golf ball is then finished as desired through processing such as coating or mark-stamping.

FIG. 1 is a sectional view showing a golf ball according to an embodiment of the present invention. In FIG. 1, reference numeral 2 denotes a spherical outer-layer core having a spherical cavity 4 that is formed concentrically with the outer-layer core 2. The outer diameter a of the outer-layer core 2 is 36.7–41.7 mm. The wall thickness b of the outer-layer core 2 is 5–10 mm. In FIG. 1, reference numeral 6 denotes a spherical inner-layer core disposed within the spherical cavity 4 of the outer-layer core 2. The diameter c of the inner-layer core 6 is 10.7–29.7 mm, which is smaller than that of the spherical cavity 4 in the outer-layer core 2. In FIG. 1, reference numeral 8 denotes a cover formed on the outer surface of the outer-layer core 2. The thickness d of the cover 8 is 1–3 mm. The outer diameter e of the golf ball is approximately 42.7 mm. In the golf ball of the present embodiment, a liquid having a specific gravity substantially equal to that of the material of the inner-layer core 6 is charged into the space between the outer-layer core 2 and the inner-layer core 6, to thereby form a liquid layer 10 within the space. The thickness f of the liquid layer 10 is 1–3 mm.

The golf ball of the present embodiment was manufactured according to the following procedure. First, an inner-layer core 6 was formed through vulcanization and molding. Then, a pair of like hemispheric cups were molded through use of unvulcanized rubber for forming an outer-layer core 2. These two hemispheric cups were subjected to primary vulcanization (semi cure). Subsequently, the two semi-cured hemispheric cups were put on the inner-layer core 6 in such a manner that the cups enclosed the inner-layer core 6. In this case, one of the hemispheric cups had a liquid-charging through hole (represented by reference numeral 12 in FIG. 1) formed in the wall thereof. Subsequently, the hemispheric cups were subjected to secondary vulcanization (full cure), so that the hemispheric cups became adhered to each other, to thereby form the outer-layer core 2 around the inner-layer core 6. A liquid was charged into the space between the outer-layer core 2 and the inner-layer core 6 through the liquid-charging through hole 12 of the outer-layer core 2. Thus, a liquid layer 10 was formed. Then, the liquid-charging through hole 12 was plugged up with a rubber sealing plug 14 made of the same material as that used for the outer-layer core 2. Thereafter, through compression molding, a cover 8 was formed on the outer-layer core 2, and dimples were formed thereon.

EXAMPLES

A golf ball shown in FIG. 1 was manufactured according to the aforementioned procedure. Respective golf balls of Examples and Comparative Examples shown in Table 3 were manufactured by use of cores (outer-layer cores and inner-layer cores) having compositions shown in Table 1 and a cover having a composition shown in Table 2. Examples 1 and 2 and Comparative Examples 1–4 are golf balls in which an inner-layer core is disposed within the spherical cavity of an outer-layer core, and a liquid layer is formed between the outer layer core and the inner layer core. Comparative Example 5 is a conventional two-piece golf ball having a single-layer solid core with a cover being formed thereon. Therefore, with regard to Comparative Example 5, the properties of the single-layer solid core are shown in the row for the outer-layer core in Table 3.

TABLE 1

| | Composition of Core | | |
|---|---|---|---|
| | Composition (wt. %) | | |
| | A | B | C |
| Polybutadiene rubber | 100.0 | 100.0 | 100.0 |
| Zinc oxide | 17.0 | 38.5 | 5.0 |

TABLE 1-continued

| Composition of Core | Composition (wt. %) | | |
|---|---|---|---|
| | A | B | C |
| Zinc acrylate | 35.0 | 35.0 | 35.0 |
| Barium sulfate | — | — | 13.0 |
| Dicumyl peroxide | 1.2 | 1.2 | 1.2 |

TABLE 2

| Composition of Cover | Composition (wt. %) |
|---|---|
| Ionomer resin A | 50.0 |
| Ionomer resin B | 50.0 |
| Titanium dioxide | 5.2 |
| Magnesium stearate | 1.2 |

TABLE 3

| | | Example 1 | Example 2 | Comp. Ex.1 | Comp. Ex.2 | Comp. Ex.3 | Comp. Ex.4 | Comp. Ex.5 |
|---|---|---|---|---|---|---|---|---|
| Inner-Layer Core | Composition | A | A | A | A | A | B | — |
| | Diameter(mm) | 22.7 | 18.7 | 28.7 | 16.7 | 25.7 | 22.7 | — |
| | Weight(g) | 7.1 | 4.0 | 14.4 | 2.8 | 10.3 | 7.7 | — |
| | Specific Gravity | 1.162 | 1.162 | 1.162 | 1.162 | 1.162 | 1.264 | — |
| Liquid Layer | Liquid | Aqueous $Na_2O_4$ Solu-tion | Aqueous $Na_2O_4$ SoIu-tion | Aqueous $Na_2O_4$ Solu-tion | Aqueous $Na_2O_4$ Solu-tion | Aqueous $Na_2O_4$ Solu-tion | Water | — — — — |
| | Thickness(mm) | 2.0 | 2.0 | 2.0 | 5.0 | 0.5 | 2.0 | — |
| | Charged Weight(g) | 4.5 | 3.1 | 6.9 | 8.7 | 1.3 | 3.8 | — |
| | Specific Gravity | 1.162 | 1.162 | 1.162 | 1.162 | 1.162 | 1.000 | — |
| Outer-Layer Core | Composition | A | A | A | A | A | A | C |
| | Outer Diameter(mm) | 38.7 | 38.7 | 38.7 | 38.7 | 38.7 | 38.7 | 38.7 |
| | Inner Diameter(mm) | 26.7 | 22.7 | 32.7 | 26.7 | 26.7 | 26.7 | — |
| | Wall thickness(mm) | 6.0 | 8.0 | 3.0 | 6.0 | 6.0 | 6.0 | — |
| | Weight(g) | 35.3 | 35.3 | 35.3 | 35.3 | 35.3 | 35.3 | 35.3 |
| | Specific Gravity | 1.162 | 1.162 | 1.162 | 1.162 | 1.162 | 1.162 | 1.162 |
| Cover | Thickness(mm) | 2.0 | 2.0 | 2.0 | 2.0 | 2.0 | 2.0 | 2.0 |
| | Weight(g) | 10.1 | 10.1 | 10.1 | 10.1 | 10.1 | 10.1 | 10.1 |
| Ball | Diameter(mm) | 42.7 | 42.7 | 42.7 | 42.7 | 42.7 | 42.7 | 42.7 |
| | Weight(g) | 45.4 | 45.4 | 45.4 | 45.4 | 45.4 | 45.4 | 45.4 |
| Durability | | 0/10 | 0/10 | 10/10 | 0/10 | 0/10 | 0/10 | 0/10 |
| Distance Test: HS40 m/s W#1 | Launch Angle(°) | 12.1 | 11.9 | — | 11.2 | 11.7 | 11.8 | 11.7 |
| | Carry(m) | 180.7 | 179.3 | — | 170.1 | 176.3 | 176.0 | 176.7 |
| | Carry Width(m) | 7.1 | 7.8 | — | 8.2 | 15.3 | 13.8 | 14.5 |
| | Total(m) | 191.5 | 189.8 | — | 181.4 | 184.9 | 184.5 | 185.2 |

In Tables 1 and 2, BR01 (The Japan Synthetic Rubber Co., Ltd.) was used as polybutadiene rubber, Percumyl D (NOF Corp.) was used as dicumyl peroxide, Himilan 1605 (Du Pont-Mitsui Polychemicals Co., Ltd.) was used as ionomer resin A, Himilan 1706 (Du Pont-Mitsui Polychemicals Co., Ltd.) was used as ionomer resin B. In Examples 1 and 2 and Comparative Examples 1–3, water in which sodium sulfate was dissolved as an agent for adjusting specific gravity (specific gravity of the aqueous $Na_2SO_4$ solution: 1.162) was used as the liquid for forming a liquid layer, and in Comparative Example 4 water (specific gravity: 1.000) was used.

In manufacture of the golf balls of Examples 1 and 2 and Comparative Examples 1–4, the hemispheric cups were subjected to primary vulcanization at 130° C. for 12 minutes and to secondary vulcanization at 155° C. for 15 minutes, while the inner-layer core was subjected to vulcanization at 155° C. for 15 minutes. In manufacture of the conventional two-piece golf balls of Comparative Example 5, the core was subjected to vulcanization at 155° C. for 15 minutes.

The golf balls of Examples and Comparative Examples were subjected to a durability test. A swing robot manufactured by Miyamae Co., Ltd. was used in the durability test. The golf balls were hit at a head speed of 45 m/s by J's Metal No. 1 Wood (loft angle: 9.5°) manufactured by Bridgestone Sports Co., Ltd. and visual check was performed to determine whether the balls had been damaged. The test results are shown in Table 3. In Table 3, "0/10" represents that no ball was damaged among 10 hit balls. Likewise, "10/10" represents that (all) 10 balls were damaged among 10 hit balls. The balls of Comparative Example 1 had cracks after being hit.

Further, the golf balls of Examples and Comparative Examples were subjected to a distance test. In the distance test, through use of a hitting test machine, the golf balls were hit by the No. 1 Wood at a head speed of 40 m/s. The launch angle, carry travel distance, carry width and total travel distance were measured. The term "carry width" means the dispersion distance of landing spots in a direction perpendicular to the hitting direction. In the case of Comparative Example 1, the distance test could not be conducted since cracks were formed on all the hit balls. The results are shown in Table 3.

As is apparent from Table 3, the golf balls of Examples 1 and 2 according to the present invention were superior to the conventional two piece ball of Comparative Example 5 in terms of travel distance and straightness of trajectory. In contrast, the balls of Comparative Example 1 each having an outer-layer core having an excessively thin wall were broken due to the low strength of the outer-layer core, and the balls of Comparative Example 2 each having an excessively thick liquid layer exhibited decreased travel distance due to the lowered resilience of the ball. Also, the balls of Comparative Example 3 each having an excessively thin liquid layer and the balls of Comparative Example 4 wherein the specific gravity of the inner-layer core was not equal to that of the liquid layer are inferior to the golf balls of the present invention in terms of travel distance and straightness of trajectory, since the inner-layer core cannot rotate independently of the outer-layer core.

What is claimed is:

1. A golf ball comprising:

a spherical outer-layer core having a concentric spherical inner cavity and having a wall thickness of 5–10 mm;

a spherical inner-layer core disposed within the spherical cavity in the outer-layer core, having a diameter smaller than that of the spherical cavity; and a cover formed on the outer surface of the outer-layer core, wherein a liquid having a specific gravity substantially equal to that of the material of the inner-layer core is charged into the space between the outer-layer core and the inner-layer core to thereby form a liquid layer having a thickness of 1–3 mm.

2. A golf ball according to claim 1, wherein the outer-layer core has a wall thickness of 6–9 mm.

3. A golf ball according to claim 1, wherein the outer diameter of the outer-layer core is 36.7–41.7 mm.

4. A golf ball according to claim 1, wherein the outer diameter of the inner-layer core is 10.7–29.7 mm.

5. A golf ball according to claim 1, wherein the liquid layer has a thickness of 1.5–2.5 mm.

6. A golf ball according to claim 1, wherein the outer-layer core and the inner-layer core are formed of vulcanized rubber containing polybutadiene rubber as a main component.

7. A golf ball according to claim 6, wherein the liquid of the liquid layer is water that contains sodium sulfate as an agent to adjust specific gravity.

8. A golf ball according to claim 1, wherein the liquid of the liquid layer has a specific gravity of 0.9–1.2.

9. A golf ball according to claim 1, wherein the liquid of the liquid layer has a viscosity of 1–100 centipoise.

* * * * *